US011702610B2

(12) United States Patent
Knapton et al.

(10) Patent No.: US 11,702,610 B2
(45) Date of Patent: Jul. 18, 2023

(54) LUBRICATING COMPOSITIONS

(71) Applicant: The Lubrizol Corporation, Wickliffe, OH (US)

(72) Inventors: Daniel J. Knapton, Willowick, OH (US); Allison M. Williamson, Chardon, OH (US); Thomas Derevjanik, Mentor-on-the-Lake, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 17/254,574

(22) PCT Filed: Jun. 19, 2019

(86) PCT No.: PCT/US2019/037889
§ 371 (c)(1),
(2) Date: Dec. 21, 2020

(87) PCT Pub. No.: WO2019/246192
PCT Pub. Date: Dec. 26, 2019

(65) Prior Publication Data

US 2021/0269735 A1 Sep. 2, 2021

Related U.S. Application Data

(60) Provisional application No. 62/688,433, filed on Jun. 22, 2018.

(51) Int. Cl.

| | |
|---|---|
| ***C10M 153/02*** | (2006.01) |
| ***C10M 129/50*** | (2006.01) |
| ***C10M 135/10*** | (2006.01) |
| ***C10M 137/10*** | (2006.01) |
| ***C10M 141/10*** | (2006.01) |
| ***C10M 149/10*** | (2006.01) |
| ***C10M 157/08*** | (2006.01) |
| ***C10M 161/00*** | (2006.01) |
| ***C10M 169/04*** | (2006.01) |
| *C10N 30/02* | (2006.01) |
| *C10N 30/04* | (2006.01) |
| *C10N 30/06* | (2006.01) |
| *C10N 40/25* | (2006.01) |

(52) U.S. Cl.
CPC ..... *C10M 153/02* (2013.01); *C10M 129/50* (2013.01); *C10M 135/10* (2013.01); *C10M 137/10* (2013.01); *C10M 141/10* (2013.01); *C10M 149/10* (2013.01); *C10M 157/08* (2013.01); *C10M 161/00* (2013.01); *C10M 169/044* (2013.01); *C10M 2203/003* (2013.01); *C10M 2207/141* (2013.01); *C10M 2217/06* (2013.01); *C10M 2219/044* (2013.01); *C10M 2223/045* (2013.01); *C10M 2225/041* (2013.01); *C10N 2030/02* (2013.01); *C10N 2030/04* (2013.01); *C10N 2030/06* (2013.01); *C10N 2040/25* (2013.01)

(58) Field of Classification Search
CPC ..... C10M 153/02; C10M 129/50; C10M 135/10; C10M 137/10; C10M 141/10; C10M 149/10; C10M 157/08; C10M 161/00; C10M 169/044; C10M 2203/003; C10M 2207/141; C10M 2217/06; C10M 2219/044; C10M 2223/045; C10M 2225/041; C10N 2030/02; C10N 2030/04; C10N 2030/06; C10N 2040/25
USPC ..... 508/284
See application file for complete search history.

(56) References Cited

U.S. PATENT DOCUMENTS

| | | | | |
|---|---|---|---|---|
| 3,172,892 | A | 3/1965 | LeSuer et al. | |
| 3,197,405 | A | 7/1965 | LeSuer et al. | |
| 3,219,666 | A | 11/1965 | LeSuer et al. | |
| 3,340,281 | A | 9/1967 | Brannen et al. | |
| 3,351,552 | A | 11/1967 | LeSuer et al. | |
| 3,381,022 | A | 4/1968 | LeSuer et al. | |
| RE26,433 | E | 8/1968 | LeSuer et al. | |
| 3,433,744 | A | 3/1969 | LeSuer et al. | |
| 3,444,170 | A | 5/1969 | LeSuer et al. | |
| 3,467,668 | A | 9/1969 | Gruber et al. | |
| 3,501,405 | A | 3/1970 | Willette et al. | |
| 3,502,677 | A * | 3/1970 | Sner | C08F 10/00 544/243 |
| 3,542,680 | A | 11/1970 | LeSuer et al. | |
| 3,576,743 | A | 4/1971 | Widmer et al. | |
| 3,632,511 | A | 1/1972 | Liao et al. | |
| 4,056,531 | A | 11/1977 | Malec | |
| 4,234,435 | A | 11/1980 | Meinhardt et al. | |
| 4,863,623 | A | 9/1989 | Nalesnik et al. | |

(Continued)

FOREIGN PATENT DOCUMENTS

| | | |
|---|---|---|
| CA | 1183125 | 2/1985 |
| EP | 1391500 A1 | 2/2004 |

(Continued)

*Primary Examiner* — Prem C Singh
*Assistant Examiner* — Francis C Campanell
(74) *Attorney, Agent, or Firm* — Michael Miller; Eryn Fuhrer

(57) ABSTRACT

Lubricating compositions containing a phosphorus-containing salt of an acylated ethylene-α-olefin polymer substituted with an aliphatic polyamine having at least one primary or secondary amine, the lubricating composition having a total phosphorus content in an amount of 200 ppm to 600 ppm by weight of the lubricating composition. The phosphorus-containing salt additive described herein can be used as an anti-wear agent in lubricating composition for diesel engines.

14 Claims, No Drawings

(56) References Cited

U.S. PATENT DOCUMENTS

| | | | | |
|---|---|---|---|---|
| 6,107,257 | A | 8/2000 | Valcho et al. | |
| 6,107,258 | A * | 8/2000 | Esche, Jr. | C08F 255/08 508/231 |
| 6,117,825 | A | 9/2000 | Liu et al. | |
| 6,153,565 | A | 11/2000 | Skinner et al. | |
| 6,165,235 | A | 12/2000 | Kolp et al. | |
| 6,281,179 | B1 | 8/2001 | Skinner et al. | |
| 6,429,178 | B1 | 8/2002 | Skinner et al. | |
| 6,429,179 | B1 | 8/2002 | Skinner et al. | |
| 6,586,375 | B1 | 7/2003 | Gahagan et al. | |
| 7,009,072 | B2 | 3/2006 | Muir | |
| 7,238,650 | B2 | 7/2007 | Calder et al. | |
| 7,285,516 | B2 | 10/2007 | Carrick et al. | |
| 7,407,919 | B2 | 8/2008 | Wilk et al. | |
| 7,615,521 | B2 | 11/2009 | Eveland et al. | |
| 7,790,661 | B2 | 9/2010 | Covitch et al. | |
| 2005/0198894 | A1 | 9/2005 | Migdal et al. | |
| 2010/0197536 | A1 | 8/2010 | Mosier et al. | |
| 2010/0298185 | A1 | 11/2010 | Gieselman et al. | |
| 2011/0306528 | A1 | 12/2011 | Gieselman et al. | |
| 2017/0158982 | A1 * | 6/2017 | Tamura | C10M 163/00 |

FOREIGN PATENT DOCUMENTS

| | | | |
|---|---|---|---|
| WO | 2006/015130 | A1 | 2/2006 |
| WO | 2006/044411 | A1 | 4/2006 |
| WO | 2006/047486 | A1 | 5/2006 |
| WO | 2008/147704 | A1 | 12/2008 |
| WO | 2011/146467 | A1 | 11/2011 |
| WO | 2015/021119 | A1 | 2/2015 |
| WO | 2017/105747 | A1 | 6/2017 |

* cited by examiner

LUBRICATING COMPOSITIONS

CROSS REFERENCE TO RELATED APPLICATION

This application claims priority from PCT Application Serial No. PCT/US2019/037889 filed on Jan. 19, 2019, which claims the benefit of U.S. Provisional Application No. 62/688,433 filed on Jun. 22, 2018, both of which are incorporated in their entirety by reference herein.

BACKGROUND

High Hertzian stresses exist in typical diesel valve trains. Wear from these stresses is typically mitigated by employing a lubricating composition within the valve train. Typical lubricating compositions include the use of phosphorus-containing additives, such as ZDP. Additives such as ZDP and the like have become a staple additive in addressing wear in lubricating compositions used in high stress applications. However, new regulations have attempted to limit the amount of phosphorus contained in a lubricating compositions. Thus, these regulations inversely affect the amount of ZDP that can be used in lubricating compositions. Therefore, a need exists for lubricating compositions having decreased amounts of ZDP and/or lower amounts of overall phosphorus content yet still provide protection in high Hertzian stress environments.

BRIEF SUMMARY

The instant disclosure is directed to an engine lubricating composition comprising an oil of lubricating viscosity and a phosphorus-containing salt additive include a phosphorus-containing salt of an acylated ethylene-α-olefin polymer substituted with an aliphatic polyamine having at least one primary or secondary amine. The lubricating composition has a total phosphorus content in an amount of 200 ppm to 800 ppm by weight of the lubricating composition. In one embodiment, the phosphorus-containing salt additive can be used as an antiwear agent in the lubricating composition. In one embodiment, the aliphatic polyamine of the phosphorus-containing salt additive is amino-propyl morpholine.

The instant disclosure is further directed to an engine lubricating composition comprising an oil of lubricating viscosity; a phosphorus-containing salt additive include a phosphorus-containing salt of an acylated ethylene-α-olefin polymer substituted with an aliphatic polyamine having at least one primary or secondary amine; a dialkydithiophosphate antiwear additive; a dispersant; a metal-based detergent; an ashless antioxidant and, optionally, additional formulation additives and/or performance additives. The lubricating composition has a total phosphorus content in an amount of 200 ppm to 800 ppm by weight of the lubricating composition The instant disclosure is further directed to an engine lubricating composition comprising an oil of lubricating viscosity; of a phosphorus-containing salt additive include a phosphorus-containing salt of an acylated ethylene-α-olefin polymer substituted with an aliphatic polyamine having at least one primary or secondary amine; of a dialkydithiophosphate antiwear additive; of a dispersant; a metal sulfonate detergent; a metal phenate detergent; an ashless antioxidant and, optionally, additional formulation additives and/or performance additives, wherein the lubricating composition has a total phosphorus content in an amount of 200 ppm to 800 ppm by weight of the lubricating composition.

The instant disclosure is further directed an engine lubricating composition comprising an oil of lubricating viscosity; 0.1 wt % to 5 wt % of a phosphorus-containing salt additive include a phosphorus-containing salt of an acylated ethylene-α-olefin polymer substituted with an aliphatic polyamine having at least one primary or secondary amine; 0 wt % to 1.5 wt % of a dialkydithiophosphate antiwear additive; 0.8 wt % to 6 wt % of a dispersant; 0.2 wt % to 4 wt % of a metal sulfonate detergent; 0.1 wt % to 1 wt % of a metal phenate detergent; 0.5 wt % to 6 wt % of an ashless antioxidant and, optionally, additional formulation additives and/or performance additives, wherein the lubricating composition has a total phosphorus content in an amount of 200 ppm to 800 ppm by weight of the lubricating composition.

The instant disclosure is further directed to an engine lubricating composition comprising an oil of lubricating viscosity; 0.1 wt % to 5 wt % of a phosphorus-containing salt additive include a phosphorus-containing salt of an acylated ethylene-α-olefin polymer substituted with amino-propyl morpholine; 0 wt % to 1.5 wt % of a dialkydithiophosphate antiwear additive; 0.8 wt % to 6 wt % of a dispersant; 0.2 wt % to 4 wt % of a metal sulfonate detergent; 0.1 wt % to 1 wt % of a metal phenate detergent; 0.5 wt % to 6 wt % of an ashless antioxidant and, optionally, additional formulation additives and/or performance additives, wherein the lubricating composition has a total phosphorus content in an amount of 200 ppm to 800 ppm by weight of the lubricating composition.

The instant disclosure is further directed to a method of lubricating an internal combustion engine comprising supplying to an internal combustion engine having a reference mass exceeding 2,610 kg a lubricating composition comprising an oil of lubricating viscosity and a phosphorus-containing salt additive include a phosphorus-containing salt of an acylated ethylene-α-olefin polymer substituted with an aliphatic polyamine having at least one primary or secondary amine wherein the lubricating composition has a total phosphorus content in an amount of 200 ppm to 800 ppm by weight of the lubricating composition.

The instant disclosure is further directed to a method of lubricating an internal combustion engine comprising supplying to an internal combustion engine having a reference mass exceeding 2,610 kg a lubricating composition comprising an oil of lubricating viscosity and a phosphorus-containing salt additive include a phosphorus-containing salt of an acylated ethylene-α-olefin polymer substituted with amino-propyl morpholine wherein the lubricating composition has a total phosphorus content in an amount of 200 ppm to 800 ppm by weight of the lubricating composition.

The instant disclosure is further directed to a method of lubricating an internal combustion engine comprising supplying to an internal combustion engine having a reference mass exceeding 2,610 kg a lubricating composition comprising an oil of lubricating viscosity; 0.1 wt % to 5 wt % of a phosphorus-containing salt additive include a phosphorus-containing salt of an acylated ethylene-α-olefin polymer substituted with an aliphatic polyamine having at least one primary or secondary amine; 0 wt % to 1.5 wt % of a dialkydithiophosphate antiwear additive; 0.8 wt % to 6 wt % of a dispersant; 0.2 wt % to 4 wt % of a metal sulfonate detergent; 0.1 wt % to 1 wt % of a metal phenate detergent; 0.5 wt % to 6 wt % of an ashless antioxidant and, optionally, additional formulation additives and/or performance additives, wherein the lubricating composition has a total phosphorus content in an amount of 200 ppm to 800 ppm by weight of the lubricating composition.

The instant disclosure is further directed to a method of lubricating an internal combustion engine comprising supplying to an internal combustion engine having a reference mass exceeding 2,610 kg a lubricating composition comprising an oil of lubricating viscosity; 0.1 wt % to 5 wt % of a phosphorus-containing salt additive include a phosphorus-containing salt of an acylated ethylene-α-olefin polymer substituted with amino-propyl morpholine; 0 wt % to 1.5 wt % of a dialkydithiophosphate antiwear additive; 0.8 wt % to 6 wt % of a dispersant; 0.2 wt % to 4 wt % of a metal sulfonate detergent; 0.1 wt % to 1 wt % of a metal phenate detergent; 0.5 wt % to 6 wt % of an ashless antioxidant and, optionally, additional formulation additives and/or performance additives, wherein the lubricating composition has a total phosphorus content in an amount of 200 ppm to 800 ppm by weight of the lubricating composition.

DETAILED DESCRIPTION

The present disclosure relates to lubricating compositions and a methods for lubricating an internal combustion engine. In some embodiments, the internal combustion engine is a heavy-duty diesel engine, as disclosed herein.

Lubricating compositions according to the instant disclosure include an oil of lubricating viscosity and a phosphorus-containing salt of an acylated ethylene-α-olefin polymer substituted with an aliphatic polyamine having at least one primary or secondary amine (sometimes referred to herein as the "phosphorus-containing salt additive"). The lubricating composition further includes a total phosphorus content in an amount of from about 200 ppm to about 800 ppm by weight of the lubricating composition. In another embodiment, the total phosphorus content can be in an amount of from about 300 ppm to about 500 ppm of the lubricating composition. In some embodiments, the lubricating composition includes a total phosphorus content in an amount of from 300 to 500 ppm by weight of the lubricating composition. In some embodiments, the lubricating composition may include further performance additives, as set forth herein.

Oils of Lubricating Viscosity

As used herein, an oil of lubricating viscosity may include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). The cited portions of both references are incorporated herein. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10), which are hereby incorporated herein by reference.

In one embodiment the oil of lubricating viscosity may be an API Group I to IV mineral oil, an ester or a synthetic oil, or mixtures thereof. In one embodiment the oil of lubricating viscosity may be an API Group II, Group III, Group IV mineral oil, an ester or a synthetic oil, or mixtures thereof.

The amount of the oil of lubricating viscosity present is typically the balance remaining after subtracting from 100 wt % the sum of the amount of the phosphorus-containing salt additive according to the instant disclosure and additional, if any, performance additives.

The lubricating composition may be in the form of a concentrate and/or a fully formulated lubricant. If the lubricating composition of the instant disclosure (comprising the phosphorus-containing salt additive disclosed herein and, optionally, other performance additives) is in the form of a concentrate which may be combined with additional oil to form, in whole or in part, a finished lubricant, the ratio of the of these additives to the oil of lubricating viscosity and/or to diluent oil include the ranges of 1:99 to 99:1 by weight, or 80:20 to 10:90 by weight. Typically, the lubricating composition of the invention comprises at least 50 wt %, or at least 60 wt %, or at least 70 wt %, or at least 80 wt % of an oil of lubricating viscosity.

In the present invention, the lubricating composition comprises a base oil having a kinematic viscosity measured at 100° C. of 2.4 $m^2/s$ to 6.4 $m^2/s$. In some embodiments, the kinematic viscosity is from 4.0 $m^2/s$ to 5.0 $m^2/s$ or from 5.2 $m^2/s$ to 5.8 $m^2/s$ or from 6.0 $m^2/s$ to 6.5 $m^2/s$. In other embodiments, the kinematic viscosity is 6.2 $m^2/s$ or 5.6 $m^2/s$ or 4.6 $m^2/s$.

Acylated Ethylene-α-Olefin Copolymer

The lubricating composition of the instant disclosure includes a phosphorus-containing salt of an acylated ethylene-α-olefin copolymer substituted with an aliphatic polyamine having at least one primary or secondary amine a functionalized olefin copolymer. In one embodiment, the functionalized olefin copolymer is an acylated ethylene-α-olefin copolymer. As used herein, the term "acylated" means that the olefin polymer has been modified by the addition of a carboxylic and/or an anhydride moiety. "Acyl" or "acyl group" as used herein refers to a group having an —C(O)R structure being derived from a carboxylic acid, where R is a hydrocarbyl group, as defined herein. The olefin polymer and process for addition of an acylated moiety is described in more detail below.

The olefin polymer may be formed from ethylene and a higher olefin within the range of C3-C10 alpha-mono-olefins, for example, the olefin polymer may be prepared from ethylene and propylene.

In one embodiment, the olefin polymer may be a polymer of 15 to 80 mole percent of ethylene, for example, 30 mol percent to 70 mol percent ethylene and from and from 20 to 85 mole percent of C3 to C10 mono-olefins, such as propylene, for example, 30 to 70 mol percent propylene or higher mono-olefins. Terpolymer variations of the olefin copolymer may also be used and may contain up to 15 mol percent of a non-conjugated diene or triene. Non-conjugated dienes or trienes may have 5 to about 14 carbon atoms. The non-conjugated diene or triene monomers may be characterized by the presence of a vinyl group in the structure and can include cyclic and bicycle compounds. Representative dienes include 1,4-hexadiene, 1,4-cyclohexadiene, dicyclopentadiene, 5-ethyldiene-2-norbornene, 5-methylene-2-norbornene, 1,5-heptadiene, and 1,6-octadiene.

In one embodiment, the olefin polymer may be a polymer of ethylene, propylene, and butylene. The polymer may be prepared by polymerizing a mixture of monomers comprising ethylene, propylene and butylene. Such polymers may be referred to as terpolymers. In one embodiment of the invention, a useful terpolymer may comprise from about 5 mol % to about 20 mol %, or from about 5 mol % to about 10 mol % structural units derived from ethylene; from about 60 mol % to about 90 mol %, or from about 60 mol % to about 75 mol structural units derived from propylene; and from about 5 mol % to about 30 mol %, or from about 15 mol % to about 30 mol % structural units derived from butylene. The butylene may comprise any isomers or mixtures thereof, such as n-butylene, iso-butylene, or a mixture thereof. The butylene may comprise butene-1. Commercial sources of butylene may comprise butene-1 as well as butene-2 and butadiene. In one embodiment, the butylene may comprise a mixture of butene-1 and isobutylene wherein the weight ratio of butene-1 to isobutylene is about 1:0.1 or less. In another embodiment, the butylene may comprise butene-1 and be free of or essentially free of isobutylene.

In another exemplary embodiment, the olefin copolymer may be a polymer of ethylene and butylene, which may be prepared by polymerizing a mixture of monomers comprising ethylene and butylene wherein, the monomer composition is free of or substantially free of propylene monomers (i.e. contains less than 1 weight percent of intentionally added monomer). In this embodiment, the copolymer may comprise 30 to 50 mol percent structural units derived from butylene; and from about 50 mol percent to 70 mol percent structural units derived from ethylene. The butylene may comprise a mixture of butene-1 and isobutylene wherein the weight ratio of butene-1 to isobutylene is about 1:0.1 or less. The butylene may comprise butene-1 and be free of or essentially free of isobutylene.

Suitable olefin polymers include ethylene-α-olefin copolymers have a number average molecular weight, determined by Gel Permeation Chromatography (GPC) using a polystyrene standard, ranging from 1000 to 500,000 Daltons, for example, 3000 to 300,000 Daltons, or even 3000 to 200,000 Daltons, or even 3000 to 120,000 Daltons, or 5000 to 60,000 Daltons, or 5000 to 50,000 Daltons or 5000 to 150,000 Daltons, or 7000 to 120,000 Daltons or 8000 to 100,000 Daltons.

The olefin polymers are functionalized by modifying the polymer by the addition of an acyl group. In one embodiment, the acylated copolymer is the reaction product of an olefin polymer grafted with an acylating agent. In one embodiment, the acylating agent may be an ethylenically unsaturated acylating agent. Useful acylating agents are typically α,β unsaturated compounds having at least one ethylenic bond (prior to reaction) and at least one, for example two, carboxylic acid (or its anhydride) groups or a polar group which is convertible into said carboxyl groups by oxidation or hydrolysis. The acylating agent grafts onto the olefin polymer to give two carboxylic acid functionalities. Examples of suitable acylating agents include maleic anhydride, chlormaleic anhydride, itaconic anhydride, or the reactive equivalents thereof, for example, the corresponding dicarboxylic acids, such as maleic acid, fumaric acid, cinnamic acid, (meth)acrylic acid, the esters of these compounds and the acid chlorides of these compounds.

In one embodiment, the acylated ethylene-α-olefin polymer comprises an olefin copolymer grafted with the acyl group which is further functionalized with a hydrocarbyl amine having at least one primary or secondary amine. In one embodiment, the hydrocarbyl amine is an aliphatic polyamine having at least one primary or secondary amine. In another embodiment, the amine is an aliphatic diamine having a first primary amine and a second secondary or tertiary amine. In one embodiment, the amine is an aliphatic polyamine having a cycloaliphatic tertiary amine. In one embodiment, the amine may include an amine according to the following structure:

$$H_2N—R_1—NR_2R_3,$$

where, $R_1$ is a linear or branched, optionally substituted, alkyl having from 1 to 10 carbon atoms or a hydrocarbyl group having 1 to 12 carbon atoms;

$R_2$ and $R_3$ along with the adjacent N form a 6-membered ring, optionally, having at least one heteroatom.

In one embodiment, the amine is a piperidinepropylamine having the following structure:

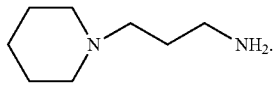

In one embodiment, the amine is amino-propyl morpholine having the following structure:

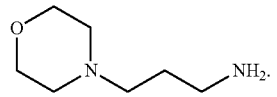

In another embodiment, the amine includes an amine according to the following structure:

$$R_5R_6N—(CH_2)_3—NH_2$$

where, $R_5$ and $R_6$ are independently a hydrocarbyl group having 1 to 24 or 6 to 24 or 8 to 18 carbon atoms. In one embodiment, $R_5$ and $R_6$ are independently a hydrocarbyl group having 12 to 18 carbon atoms.

The amine functional group may be added to the olefin polymer by reacting an ethylene-α-olefin copolymer, such as an ethylene-propylene copolymer, with an acylating agent. e.g., maleic anhydride, and a hydrocarbyl amine having a primary or secondary amino group. In one embodiment, the hydrocarbyl amine may be selected from aromatic or heteroaromatic amines, aliphatic amines, and mixtures thereof.

In one embodiment, the hydrocarbyl amine component may comprise at least one aliphatic amine containing at least one amino group capable of condensing with said acyl group to provide a pendant group and at least one additional group comprising at least one nitrogen, oxygen, or sulfur atom. Suitable aliphatic amines include polyethylene polyamines (such as tetraethylene pentamine (TEPA), triethylene tetra amine (TETA), pentaethylene hexamine (PEHA), and polyamine bottoms), N,N-dimethylaminopropylamine (DMAPA), N-(aminopropyl)morpholine, N,N-dilsostearylaminopropylamine, ethanolamine, and combinations thereof.

In another one embodiment, the polar moiety added to the functionalized ethylene-α-olefin copolymer may be derived from a hydrocarbyl alcohol group, containing at least one hydroxy group capable of condensing with said acyl group to provide a pendant group and at least one additional group comprising at least one nitrogen atom. The alcohol functional groups may be added to the olefin polymer by reacting the olefin copolymer with an acylating agent (typically maleic anhydride) and a hydrocarbyl alcohol. Suitable hydrocarbyl alcohols include dimethylaminopropanol, 4-(2-hydroxyethyl)morpholine and isomers, 4-(3-hydroxypropyl) morpholine and isomers.

In another one embodiment, the polar moiety added to the functionalized ethylene-α-olefin copolymer may be amine-terminated polyether compounds, hydroxy-terminated polyether compounds, and mixtures thereof. The amine terminated polyether may be selected from the group comprising mixtures of one or more amine terminated polyether compounds containing units derived from ethylene oxides, propylene oxides, butylene oxides or some combination thereof, or some combination thereof. Suitable polyether compounds include Jeffamine® line of polyether amines available from Huntsman.

The formation of functionalized ethylene-α-olefin copolymer is well known in the art, for instance those described in U.S. Pat. No. 7,790,661 column 2, line 48 to column 10, line 38. Additional detailed descriptions of similar functionalized ethylene-α-olefin copolymers are found in International Publication WO2006/015130 or U.S. Pat. Nos. 4,863,623; 6,107,257; 6,107,258; 6,117,825; and 7,790,661. In one embodiment the functionalized ethylene-α-olefin copolymer may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment, the resultant amine substituted acylated copolymer may represented by formula:

$$R_2R_3N—R_1—NH_{(2-x)}—C(=O)_x\text{-(ethylene-}\alpha\text{-olefin polymer)},$$

where:

$R_1$, $R_2$, and $R_3$ are defined above; and x is 1 or 2.

In some embodiments, the N:CO ratio between the amine and the acylating agent is between 1:0.9 to 1.2.2

The amine substituted acylated copolymer further includes a phosphorus-containing salt. The amine functionality on the amine substituted acylated copolymer may form a salt bridge with a phosphorus-containing acid to form the phosphorus salt of the amine substituted acylated copolymer. In one embodiment, the phosphorus-containing acid used to form the salt bridge with the amine functionality is a $C_1$-$C_{14}$ alkyldihiophosphoric acid. In another embodiment, the phosphorus-containing acid used to form the salt bridge with the amine functionality is derived from a phosphorus-containing acid represented by the formula:

$$H_n—(X)_n—\overset{\overset{\displaystyle X}{\|}}{P}—(XR)_{3-n},$$

wherein each X is independently sulfur or oxygen;

n=1 or 2; and each R group is a hydrocarbyl group containing 6 to 24 carbon atoms.

As used herein, "derived" means that the identified compound, such as an acid, is a precursor of the identified group or moiety. For example, a moiety "derived" from a phosphorus-containing acid is one that has as its precursor, the cited phosphorus-containing acid or compound.

In some embodiments, the amount of phosphorus-containing acid used to form the salt of the amine-substituted acylated copolymer is such that the molar ratio of basic (amine) nitrogen ($N_B$) to phosphorus from the phosphorus-containing acid ($P_A$) may be 3:1 to 1:1 ($N_B$:$P_A$).

The final product formed by the phosphorus salt of the amine substituted acylated copolymer is referred to as the phosphorus-containing additive. Lubricating compositions according to the instant disclosure may include 0.05 wt % to 3 wt %, or 0.08 wt % to 1.8 wt %, or 0.1 to 1.6 wt %, or 0.4 to 1.2 wt % of the phosphorus-containing salt additive.

The phosphorous-containing salt additive of the instant disclosure may be used as an anti-wear additive in a lubricating composition. In some embodiments, the phosphorus-containing additive allows for formulating lubricating compositions having a reduced overall phosphorus content. In some embodiments, a lubricating composition containing the instant phosphorus-containing additive may have a total phosphorus content of less than about 200 ppm to about 600 ppm by weight of the lubricating composition. In other embodiments, the total phosphorus content of a lubricating composition is about 250 ppm to about 550 ppm. In another embodiment, the total phosphorus content of a lubricating composition is about 300 to about 500 ppm. In yet another embodiment, the total phosphorus content of a lubricating composition is about 350 ppm to about 500 ppm. In another embodiment, the total phosphorus content of a lubricating composition is about 400 ppm to about 500 ppm.

The lubricating compositions disclosed herein can have a high temperature high shear viscosity (HTHS) of 1.5 mPa-s to 3.5 mPa-s as measured at 150° C. per ASTM D4683. In one embodiment, the HTHS can be 2.0 mPa-s to 3.5 mPa-s as measured at 150° C. per ASTM D4683. In another embodiment, the HTHS of the lubricating composition can be 2.5 mPa-s to 3.0 mPa-s. In one embodiment the HTHS viscosity of the lubricating composition is less than 2.0 mPa-s.

The lubricating compositions disclosed herein may be used in a compression-ignition internal combustion engines referred to as a heavy duty diesel engine. The laden mass (sometimes referred to as gross vehicle weight rating (GVWR)) may be over 2,610 kg (or over 5,700 USA pounds) 2,700 kg, or over 2,900 kg, or over 3,000 kg, or over 3,300 kg, or over 3,500 kg, or over 3,700 kg, or over 3,900 kg (or 8,500 USA pounds). Typically the upper limit on the laden mass or GVWR may be set by national government and may be 10,000 kg, or 9,000 kg, or 8,000 kg, or 7,500 kg. The upper ranges of laden mass may be up to 400,000 kg, or up to 200,000 kg, or up to 60,000 kg, or up to 44,000 kg, or up to 40,000 kg. Typically a laden mass above 120,000 may be for an off-highway vehicle.

Heavy duty diesel engines are noted to be limited to all motor vehicles with a "technically permissible maximum laden mass" over 3,500 kg, equipped with compression ignition engines or positive ignition natural gas (NG) or LPG engines. In contrast, the European Union indicates that for new light duty vehicles (passenger cars and light commercial vehicles) included within the scope of ACEA testing section "C" have a "technically permissible maximum laden mass" not exceeding 2610 kg.

There is a distinct difference between passenger car, and heavy duty diesel engines. The difference in size from over 3,500 kg to not more than 2610 kg means that engines of both types will experience significantly different operating conditions such as load, oil temperatures, duty cycle and engine speeds. Heavy duty diesel engines are designed to maximize torque for hauling payloads at maximum fuel economy while passenger car diesels are designed for commuting people and acceleration at maximum fuel economy. The designed purpose of the engine hauling versus communing results in different hardware designs and resulting stresses imparted to lubricant designed to protect and lubricate the engine. Another distinct design difference is the operating revolution per minute (RPM) that each engine operates at to haul versus commute. A heavy duty diesel engine such as a typical 12-13 litre truck engine would typically not exceed 2200 rpm while a passenger car engine can go up to 4500 rpm.

In one embodiment the internal combustion engine may be a heavy duty diesel compression ignited (or spark assisted compression ignited) internal combustion engine.

The instant disclosure further relates to methods for lubricating an internal combustion engine with a lubricating composition disclosed herein. In one embodiment, the internal combustion engine has a reference mass exceeding 2,610 kg. The methods of the instant disclosure include supplying to the internal combustion engine a lubricating composition including an oil of lubricating viscosity and a phosphorus-containing salt of an amine-substituted acylated ethylene-α-olefin copolymer where the amine is an aliphatic polyamine having at least one primary or secondary amine. The lubricating compositions of the instant method comprise a total phosphorus content in an amount of 200 ppm to 600 ppm by weight of the lubricating compositions. Various embodiments for the lubricating composition suitable for use in the instant methods are disclosed herein.

Formulation Additives:

The disclosed lubricating composition may further contain one or more of the following formulation additives:

Anti-Wear Agent

Anti-wear agents include phosphorus-containing compounds as well as phosphorus free compounds. In one embodiment, the anti-wear additive comprises a phosphorus-containing compound different than the compound of the invention, a phosphorus-free compound, or combinations thereof.

Phosphorus-containing anti-wear agents are well known to one skilled in the art and include metal dialkyl(dithio) phosphate salts, hydrocarbyl phosphites, hydrocarbyl phosphines, hydrocarbyl phosphonates, alkylphosphate esters, amine or ammonium (alkyl)phosphate salts, and combinations thereof.

In one embodiment, the phosphorus-containing ant-wear agent may be a metal dialkyldithiophosphate, which may include a zinc dialkyldithiophosphate. Such zinc salts are often referred to as zinc dialkyldithiophosphates (ZDDP) or simply zinc dithiophosphates (ZDP). They are well known and readily available to those skilled in the art of lubricant formulation. Further zinc dialkyldithiophosphates may be described as primary zinc dialkyldithiophosphates or as secondary zinc dialkyldithiophosphates, depending on the structure of the alcohol used in its preparation. In some embodiments, the instant compositions may include primary zinc dialkyldithiophosphates. In some embodiments, the compositions include secondary zinc dialkyldithiophosphates. In some embodiments, the compositions include a mixture of primary and secondary zinc dialkyldithiophosphates. In some embodiments component (b) is a mixture of primary and secondary zinc dialkyldithiophosphates where the ratio of primary zinc dialkyldithiophosphates to secondary zinc dialkyldithiophosphates (one a weight basis) is at least 1:1, or even at least 1:1.2, or even at least 1:1.5 or 1:2, or 1:10.

Examples of suitable metal dialkyldithiophosphate include metal salts of the formula:

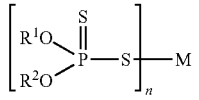

where $R^1$ and $R^2$ are independently hydrocarbyl groups containing 3 to 24 carbon atoms, or 3 to 12 carbon atoms, or 3 to 8 carbon atoms; M is a metal having a valence n and generally incudes zinc, copper, iron, cobalt, antimony, manganese, and combinations thereof. In one embodiment $R^1$ and $R^2$ are secondary aliphatic hydrocarbyl groups containing 3 to 8 carbon atoms, and M is zinc.

ZDDP may be present in the composition in an amount to deliver 0.01 weight percent to 0.12 weight percent phosphorus to the lubricating composition. ZDDP may be present in an amount to deliver at least 100 ppm, or at least 300 ppm, or at least 500 ppm of phosphorus to the composition up to no more than 1200 ppm, or no more than 1000 ppm, or no more than 800 ppm phosphorus to the composition.

In one embodiment, the phosphorus-containing anti-wear agent may be a zinc free phosphorus compound. The zinc-free phosphorus anti-wear agent may contain sulfur or may be sulfur-free. Sulfur-free phosphorus-containing antiwear agents include hydrocarbyl phosphites, hydrocarbyl phosphines, hydrocarbyl phosphonates, alkylphosphate esters, amine or ammonium phosphate salts, or mixtures thereof.

Phosphorus esters include compounds such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Amine phosphates may be amine salts of (i) monohydrocarbylphosphoric acid, (ii) dihydrocarbylphosphoric acid, (iii) hydroxy-substituted di-ester of phosphoric acid, or (iv) phosphorylated hydroxy-substituted di- or tri-ester of phosphoric acid. The amine salt of a sulfur-free phosphorus-containing compound may be salts of primary amines, secondary amines, tertiary amines, or mixtures thereof.

Amine phosphate salts may be derived from mono- or di-hydrocarbyl phosphoric acid (typically alkyl phosphoric acid), or mixtures thereof. The alkyl of the mono- or di-hydrocarbyl phosphoric acid may comprise linear or branched alkyl groups of 3 to 36 carbon atoms. The hydrocarbyl group of the linear or branched hydrocarbylphosphoric acid may contain 4 to 30, or 8 to 20 carbon atoms. Examples of a suitable hydrocarbyl group of the hydrocarbyl phosphoric acid may include isopropyl, n-butyl, sec-butyl, amyl, 4-methyl-2-pentyl (i.e. methylamyl), n-hexyl, n-heptyl, n-octyl, iso-octyl, 2-ethylhexyl, nonyl, 2-propylheptyl, decyl, dodecyl, tetradecyl, hexadecyl, octadecyl, oleyl, or combinations thereof. In one embodiment, the phosphate is a mixture of mono- and di-(2-ethylhexyl)phosphate.

Examples of suitable primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as coco, oleyl, tallow, or stearyl groups.

In one embodiment, the amine phosphate may be derived from aromatic amines, i.e. amines substituted with one or more aryl groups. The aryl groups may be substituted, unsubstituted, or combinations thereof. The aryl groups may be substituted with hydrocarbyl groups, acyl groups, hydroxy groups, alkoxy groups, and combinations thereof. Examples of suitable aromatic amines include anilines, diphenylamines, phenylene diamines, and derivatives thereof.

In one embodiment, the aromatic amine phosphate is a phosphate salt of an aniline compound represented by the formula

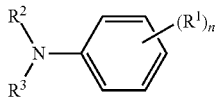

where n=0, 1, or 2; each $R^1$ is independently selected from a hydrocarbyl group of 1 to 20 carbon atoms, —C(=O)X$R^4$, —O$R^5$, or combinations thereof, $R^2$ and $R^3$ are independently hydrogen or an aliphatic hydrocarbyl group of 1 to 12 carbon atoms; X is oxygen or —N$R^6$—; $R^4$ is selected from a hydrocarbyl group of 1 to 24 carbon atoms, a (poly)ether group according to the formula —$(CH_2CHR^7O)_m$—$R^8$, or combinations thereof, $R^5$ is hydrogen, a hydrocarbyl group of 1 to 24 carbon atoms, a (poly)ether group according to the formula —$(CH_2CHR^7O)_m$—$R^8$; $R^6$ is hydrogen or a hydrocarbyl group of 1 to 12 carbon atoms; m is an integer from 1 to 20; each $R^7$ is independently hydrogen, a hydrocarbyl group of 1 to 20 carbon atoms, or combinations thereof, and R8 is hydrogen or a hydrocarbyl group of 1 to 24 carbon atoms. Suitable aniline compounds include N,N-dihydrocarbylanilines, such as N,N-di(hexyl)aniline; hydrocarbyl esters of anthranilic acid, such as methyl-, ethyl-, propyl-, butyl-, hexyl-, octyl, iso-octyl, 2-ethylhexyl, decyl-, iso-decyl-, dodecyl-, tridecyl-, isotridecyl, hexadecyl-, oleyl, stearyl-esters and combinations thereof, and alkoxy-substituted anilines, such as p-anisidine, p-ethoxyaniline, and N,N-di(2-ethylhexyl)-p-ethoxyaniline.

In one embodiment, the aromatic amine phosphate is a phosphate salt of a diaryl amine compound represented by the formula

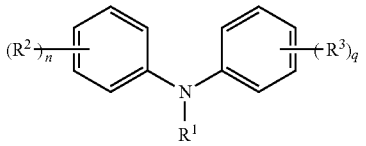

where $R^1$ is selected from hydrogen, a hydrocarbyl group of 1 to 24 carbon atoms, an acyl-containing group according to the formula —$CH_2CH_2$(C=O)O$R^4$, an alkoxylate according to the formula —$(CH_2CHR^5O)_m$—$R_6$, or combinations thereof; $R^2$ and $R^3$ are each independently hydrocarbyl groups of 4 to 18 carbon atoms; each n and q is independently 0, 1, or 2; $R^4$ is a hydrocarbyl group of 1 to 18 carbon atoms; each $R^5$ is independently hydrogen or a hydrocarbyl group of 1 to 18 carbon atoms; $R^6$ is hydrogen or a hydrocarbyl group of 1 to 18 carbon atoms; and m is an integer from 1 to 20. When either n or q is 2 and the two hydrocarbyl groups ($R^2$ or $R^3$ as applicable) are on adjacent carbons of the ring, they may be taken together to form 5- or 6-membered rings that may be saturated, unsaturated, or aromatic. Suitable diaryl amine compounds include diphenylamine, phenyl-α-naphthylamine, alkylated diphenylamine, alkylated phenyl-α-naphthylamine, and combinations thereof. Alkylated diarylamines may have one, two, three, or even four alkyl groups; alkyl groups may be branched or linear and contain 4 to 18 carbon atoms, 6 to 12 carbon atoms, or 8 to 10 carbon atoms.

In one embodiment, the zinc-free phosphorus anti-wear agent may be selected from phosphites, phosphonates, alkylphosphate esters, amine or ammonium phosphate salts, or mixtures thereof and is present in the lubricant composition in amount 0.01 to 5 percent by weight of the composition, or 0.1 to 3.2 weight percent of the composition, or 0.35 to 1.8 weight percent of the composition. In one embodiment, the zinc-free phosphorus anti-wear agent may be present in an amount to provide 0.01 weight percent to 0.15 weight percent phosphorus, or 0.025 to 0.085 weight percent phosphorus, or 0.025 to 0.065 weight percent phosphorus to the composition.

In one embodiment, the anti-wear agent may be a phosphorus-free compound. Examples of suitable phosphorus-free antiwear agents include titanium compounds, hydroxy-carboxylic acid derivatives such as esters, amides, imides or amine or ammonium salt, sulfurized olefins, (thio)carbamate-containing compounds, such as (thio)carbamate esters, (thio)carbamate amides, (thio)carbamic ethers, alkylene-coupled (thio)carbamates, and bis(S-alkyl(dithio)carbamyl) disulfides. Suitable hydroxy-carboxylic acid derivatives include tartaric acid derivatives, malic acid derivatives, citric acid derivatives, glycolic acid derivatives, lactic acid derivatives, and mandelic acid derivatives.

The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

The anti-wear agent may be represented by the formula:

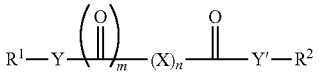

wherein Y and Y' are independently —O—, >NH, >N$R^3$, or an imide group formed by taking together both Y and Y' groups and forming a $R^1$—N< group between two >C=O groups; X is independently —Z—O—Z'—, >$CH_2$, >C$HR^4$, >C$R^4R^5$, >C(OH)($CO_2R^2$), >C($CO_2R^2$)$_2$, or >CHO$R^6$; Z and Z' are independently >$CH_2$, >C$HR^4$, >C$R^4R^5$, >C(OH)($CO_2R^2$), or >CHO$R^6$; n is 0 to 10, with the proviso that when n=1, X is not >$CH_2$, and when n=2, both X's are not >$CH_2$; m is 0 or 1; $R^1$ is independently hydrogen or a hydrocarbyl group, typically containing 1 to 150 carbon atoms, with the proviso that when $R^1$ is hydrogen, m is 0, and n is more than or equal to 1; $R^2$ is a hydrocarbyl group, typically containing 1 to 150 carbon atoms; $R^3$, $R^4$ and $R^5$ are independently hydrocarbyl groups; and $R^6$ is hydrogen or a hydrocarbyl group, typically containing 1 to 150 carbon atoms.

The phosphorus-free antiwear agent may be present at 0 wt % to 3 wt %, or 0.1 wt % to 1.5 wt %, or 0.5 wt % to 1.1 wt % of the lubricating composition.

The antiwear agent, be it phosphorus-containing, phosphorus free, or mixtures, may be present at 0.15 weight % to 6 weight %, or 0.2 weight % to 3.0 weight %, or 0.5 weight % to 1.5 weight % of the lubricating composition.

Ashless Antioxidant

The instant compositions may include an ashless antioxidant. Ashless antioxidants may comprise one or more of arylamines, diarylamines, alkylated arylamines, alkylated diaryl amines, phenols, hindered phenols, sulfurized olefins, or mixtures thereof. In one embodiment the lubricating composition includes an antioxidant, or mixtures thereof. The antioxidant may be present at 1.2 weight % to 7 weight %, or 1.2 weight % to 6 weight %, or 1.5 weight % to 5 weight %, of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment, the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The diarylamine antioxidant may be present on a weight basis of this lubrication composition at 0.1% to 10%, 0.35% to 5%, or even 0.5% to 2%.

The phenolic antioxidant may be a simple alkyl phenol, a hindered phenol, or coupled phenolic compounds.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4 propyl-2,6-di-tert-butyl¬phenol or 4-butyl-2,6-di-tert-butylphenol, 4-dodecyl-2,6-di-tert-butyl¬phenol, or butyl 3-(3,5-ditert-butyl-4-hydroxyphenyl)propanoate. In one embodiment, the hindered phenol antioxidant may be an ester and may include, e.g., Irganox™ L-135 from Ciba.

Coupled phenols often contain two alkylphenols coupled with alkylene groups to form bisphenol compounds. Examples of suitable coupled phenol compounds include 4,4'-methylene bis-(2,6-di-tert-butyl phenol), 4-methyl-2,6-di-tert-butylphenol, 2,2'-bis-(6-t-butyl-4-heptylphenol); 4,4'-bis(2,6-di-t-butyl phenol), 2,2'-methylenebis(4-methyl-6-t-butylphenol), and 2,2'-methylene bis(4-ethyl-6-t-butylphenol).

Phenols may include polyhydric aromatic compounds and their derivatives. Examples of suitable polyhydric aromatic compounds include esters and amides of gallic acid, 2,5-dihydroxybenzoic acid, 2,6-dihydroxybenzoic acid, 1,4-dihydroxy-2-naphthoic acid, 3,5-dihydroxynaphthoic acid, 3,7-dihydroxy naphthoic acid, and mixtures thereof.

In one embodiment, the phenolic antioxidant comprises a hindered phenol. In another embodiment the hindered phenol is derived from 2,6-ditertbutyl phenol.

In one embodiment the lubricating composition comprises a phenolic antioxidant in a range of 0.01 wt % to 5 wt %, or 0.1 wt % to 4 wt %, or 0.2 wt % to 3 wt %, or 0.5 wt % to 2 wt % of the lubricating composition.

Sulfurized olefins are well known commercial materials, and those which are substantially nitrogen-free, that is, not containing nitrogen functionality, are readily available. The olefinic compounds which may be sulfurized are diverse in nature. They contain at least one olefinic double bond, which is defined as a non-aromatic double bond; that is, one connecting two aliphatic carbon atoms. These materials generally have sulfide linkages having 1 to 10 sulfur atoms, for instance, 1 to 4, or 1 or 2.

Ashless antioxidants may be used separately or in combination. In one embodiment, two or more different antioxidants are used in combination, such that there is at least 0.1 weight percent of each of the at least two antioxidants and wherein the combined amount of the ashless antioxidants is 1.2 to 7 weight percent. In one embodiment, there may be at least 0.25 to 3 weight percent of each ashless antioxidant.

Metal-Containing Detergent

Metal-containing detergents are well known in the art. They are generally made up of metal salts, especially alkali metals and alkaline earth metals, of acidic organic substrates. Metal-containing detergents may be neutral, i.e. a stoichiometric salt of the metal and substrate also referred to as neutral soap or soap, or overbased.

Metal overbased detergents, otherwise referred to as overbased detergents, metal-containing overbased detergents or superbased salts, are characterized by a metal content in excess of that which would be necessary for neutralization according to the stoichiometry of the metal and the particular acidic organic compound, i.e. the substrate, reacted with the metal. The overbased detergent may comprise one or more of non-sulfur containing phenates, sulfur containing phenates, sulfonates, salicylates, and mixtures thereof.

The amount of excess metal is commonly expressed in terms of substrate to metal ratio. The terminology "metal ratio" is used in the prior art and herein to define the ratio of the total chemical equivalents of the metal in the overbased salt to the chemical equivalents of the metal in the salt which would be expected to result from the reaction between the hydrocarbyl substituted organic acid; the hydrocarbyl-substituted phenol or mixtures thereof to be overbased, and the basic metal compound according to the known chemical reactivity and the stoichiometry of the two reactants. Thus, in a normal or neutral salt (i.e. soap) the metal ratio is one and, in an overbased salt, the metal ratio is greater than one, especially greater than 1.3. The overbased metal detergent may have a metal ratio of 5 to 30, or a metal ratio of 7 to 22, or a metal ratio of at least 11.

The metal-containing detergent may also include "hybrid" detergents formed with mixed surfactant systems including phenate and/or sulfonate components, e.g. phenate-salicylates, sulfonate-phenates, sulfonate-salicylates, sulfonates-phenates-salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively. Overbased phenates and salicylates typically have a total base number of 180 to 450 TBN. Overbased sulfonates typically have a total base number of 250 to 600, or 300 to 500. Overbased detergents are known in the art.

Alkylphenols are often used as constituents in and/or building blocks for overbased detergents. Alkylphenols may be used to prepare phenate, salicylate, salixarate, or saligenin detergents or mixtures thereof. Suitable alkylphenols may include para-substituted hydrocarbyl phenols. The hydrocarbyl group may be linear or branched aliphatic groups of 1 to 60 carbon atoms, 8 to 40 carbon atoms, 10 to 24 carbon atoms, 12 to 20 carbon atoms, or 16 to 24 carbon atoms. In one embodiment, the alkylphenol overbased detergent is prepared from an alkylphenol or mixture thereof that is free of or substantially free of (i.e. contains less than 0.1 weight percent) p-dodecylphenol. In one embodiment, the lubricating composition contains less than 0.3 weight percent of alkylphenol, less than 0.1 weight percent of alkylphenol, or less than 0.05 weight percent of alkylphenol.

The overbased metal-containing detergent may be alkali metal or alkaline earth metal salts. In one embodiment, the overbased detergent may be sodium salts, calcium salts, magnesium salts, or mixtures thereof of the phenates, sulfur-containing phenates, sulfonates, salixarates and salicylates. In one embodiment, the overbased detergent is a calcium detergent, a magnesium detergent or mixtures thereof. In one embodiment, the overbased calcium detergent may be present in an amount to deliver at least 500 ppm calcium by weight and no more than 3000 ppm calcium by weight, or at least 1000 ppm calcium by weight, or at least 2000 ppm calcium by weight, or no more than 2500 ppm calcium by weight to the lubricating composition. In one embodiment, the overbased detergent may be present in an amount to deliver no more than 500 ppm by weight of magnesium to the lubricating composition, or no more than 330 ppm by weight, or no more than 125 ppm by weight, or no more than 45 ppm by weight. In one embodiment, the lubricating composition is essentially free of (i.e. contains less than 10 ppm) magnesium resulting from the overbased detergent. In one embodiment, the overbased detergent may be present in an amount to deliver at least 200 ppm by weight of magnesium, or at least 450 ppm by weight magnesium, or at least 700 ppm by weight magnesium to the lubricating composition. In one embodiment, both calcium and magnesium containing detergents may be present in the lubricating composition. Calcium and magnesium detergents may be present such that the weight ratio of calcium to magnesium is 10:1 to 1:10, or 8:3 to 4:5, or 1:1 to 1:3. In one embodiment, the overbased detergent is free of or substantially free of sodium.

In one embodiment, the sulfonate detergent may be predominantly a linear alkylbenzene sulfonate detergent having a metal ratio of at least 8 as is described in paragraphs [0026] to [0037] of US Patent Publication 2005/065045 (and granted as U.S. Pat. No. 7,407,919). The linear alkylbenzene sulfonate detergent may be particularly useful for assisting in improving fuel economy. The linear alkyl group may be attached to the benzene ring anywhere along the linear chain of the alkyl group, but often in the 2, 3 or 4 position of the linear chain, and in some instances, predominantly in the 2 position, resulting in the linear alkylbenzene sulfonate detergent.

Salicylate detergents and overbased salicylate detergents may be prepared in at least two different manners. Carbonylation (also referred to as carboxylation) of a p-alkylphenol is described in many references including U.S. Pat. No. 8,399,388. Carbonylation may be followed by overbasing to form overbased salicylate detergent. Suitable p-alkylphenols include those with linear and/or branched hydrocarbyl groups of 1 to 60 carbon atoms. Salicylate detergents may also be prepared by alkylation of salicylic acid, followed by overbasing, as described in U.S. Pat. No. 7,009,072. Salicylate detergents prepared in this manner, may be prepared from linear and/or branched alkylating agents (usually 1-olefins) containing 6 to 50 carbon atoms, 10 to 30 carbon atoms, or 14 to 24 carbon atoms. In one embodiment, the overbased detergent is a salicylate detergent. In one embodiment, the salicylate detergent is free of unreacted p-alkylphenol (i.e. contains less than 0.1 weight percent). In one embodiment, the salicylate detergent is prepared by alkylation of salicylic acid.

The metal-containing overbased detergents may be present at 0.2 wt % to 15 wt %, or 0.3 wt % to 10 wt %, or 0.3 wt % to 8 wt %, or 0.4 wt % to 3 wt %. For example, in a heavy duty diesel engine, the detergent may be present at 2 wt % to 3 wt % of the lubricating composition. For a passenger car engine, the detergent may be present at 0.2 wt % to 1 wt % of the lubricating composition.

Metal-containing detergents contribute sulfated ash to a lubricating composition. Sulfated ash may be determined by ASTM D874. In one embodiment, the lubricating composition comprises a metal-containing detergent in an amount to deliver at least 0.4 weight percent sulfated ash to the total composition. In another embodiment, the metal-containing detergent is present in an amount to deliver at least 0.6 weight percent sulfated ash, or at least 0.75 weight percent sulfated ash, or even at least 0.9 weight percent sulfated ash to the lubricating composition. In one embodiment, the metal-containing overbased detergent is present in an amount to deliver 0.1 weight percent to 0.8 weight percent sulfated ash to the lubricating composition.

In addition to ash and TBN, overbased detergents contribute detergent soap, also referred to as neutral detergent salt, to the lubricating composition. Soap, being a metal salt of the substrate, may act as a surfactant in the lubricating composition. In one embodiment, the lubricating composition comprises 0.05 weight percent to 1.5 weight percent detergent soap, or 0.1 weight percent to 0.9 weight percent detergent soap. In one embodiment, the lubricating composition contains no more than 0.5 weight percent detergent soap. The overbased detergent may have a weight ratio of ash:soap of 5:1 to 1:2.3, or 3.5:1 to 1:2, or 2.9:1 to 1:1:7.

Ashless Polyolefin Dispersant

The lubricating compositions may comprise an ashless polyolefin dispersant. The dispersant may be a succinimide dispersant, a Mannich dispersant, a polyolefin succinic acid ester, amide, or ester-amide, or mixtures thereof. In one embodiment, the dispersant may be a borated succinimide dispersant. In one embodiment, the dispersant may be present as a single dispersant. In one embodiment, the dispersant may be present as a mixture of two or three different dispersants, wherein at least one may be a succinimide dispersant.

The succinimide dispersant may be a derivative of an aliphatic polyamine, or mixtures thereof. The aliphatic polyamine may be aliphatic polyamine such as an ethylenepolyamine, a propylenepolyamine, a butylenepolyamine, or mixtures thereof. In one embodiment, the aliphatic polyamine may be ethylenepolyamine. In one embodiment, the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from C2-C6 epoxides such as ethylene oxide, propylene oxide, and butylene oxide. Examples of polyether polyamines are sold under the Jeffamine® brand and are commercially available from Huntsman Corporation located in Houston, Tex.

The dispersant may be a N-substituted long chain alkenyl succinimide. Examples of N-substituted long chain alkenyl succinimide include polyisobutylene succinimide. Typically, the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent 0 355 895B1.

The dispersant may also be post-treated by conventional methods by a reaction with any of a variety of agents. Among these are boron compounds, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds.

The dispersant may be borated using one or more of a variety of agents selected from the group consisting of the various forms of boric acid (including metaboric acid, HBO2, orthoboric acid, H3BO3, and tetraboric acid, H2B4O7), boric oxide, boron trioxide, and alkyl borates. In one embodiment the borating agent is boric acid which may be used alone or in combination with other borating agents. Methods of preparing borated dispersants are known in the art. The borated dispersant may be prepared in such a way that they contain 0.1 weight % to 2.5 weight % boron, or 0.1 weight % to 2.0 weight % boron or 0.2 to 1.5 weight % boron or 0.3 to 1.0 weight % boron.

Suitable polyisobutylenes for use in the succinimide dispersant may include those formed from polyisobutylene or highly reactive polyisobutylene having at least about 50 mol %, such as about 60 mol %, and particularly from about 70 mol % to about 90 mol % or greater than 90 mol %, terminal vinylidene content. Suitable polyisobutenes may include those prepared using BF3 catalysts. In one embodiment, the borated dispersant is derived from a polyolefin having number average molecular weight of 350 to 3000 Daltons and a vinylidene content of at least 50 mol %, or at least 70 mol %, or at least 90 mol %.

The dispersant may be prepared/obtained/obtainable from reaction of succinic anhydride by an "ene" or "thermal" reaction, by what is referred to as a "direct alkylation process." The "ene" reaction mechanism and general reaction conditions are summarised in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that is a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may be used alone or as part of a mixture of non-borated and borated dispersants. If a mixture of dispersants is used, there may be two to five, or two to three or two dispersants.

The polyolefin dispersant may comprise a polyalphaolefins (PAO) containing dispersant selected from the group consisting of a polyalphaolefin succinimide, a polyalphaolefin succinamide, a polyalphaolefin acid ester, a polyalphaolefin oxazoline, a polyalphaolefin imidazoline, a polyalphaolefin succinamide imidazoline, and combinations thereof.

Polyalphaolefins (PAO) useful as feedstock in forming the PAO containing dispersants are those derived from oligomerization or polymerization of ethylene, propylene, and α-olefins. Suitable α-olefins include 1-butene, 1-pentene, 1-hexene, 1-heptene, 1-octene, 1-nonene, 1-decene, 1-undecene, 1-dodecene, 1-tetradecene, and 1-octadecene. Feedstocks containing a mixture of two or more of the foregoing monomers as well as other hydrocarbons are typically employed when manufacturing PAOs commercially. The PAO may take the form of dimers, trimers, tetramers, polymers, and the like.

The PAO may be reacted with maleic anhydride (MA) to form the polyalphaolefin succinic anhydride (PAO-SA) and subsequently the anhydride may reacted with one or more of polyamines, aminoalcohols, and alcohols/polyols to form polyalphaolefin succinimide, polyalphaolefin succinamide, polyalphaolefin succinic acid ester, polyalphaolefin oxazoline, polyalphaolefin imidazoline, polyalphaolefin-succinamide-imidazoline, and mixtures thereof.

The polyolefin dispersant may be present at 0.01 wt % to 20 wt %, or 0.1 wt % to 15 wt %, or 0.1 wt % to 10 wt %, or 1 wt % to 6 wt % of the lubricating composition.

Polymeric Viscosity Modifier

The lubricating composition may contain a polymeric viscosity modifier, a dispersant viscosity modifier different from that of that invention, or combinations thereof The dispersant viscosity modifier may be generally understood to be a functionalized, i.e. derivatized, form of a polymer similar to that of the polymeric viscosity modifier.

The polymeric viscosity modifier may be an olefin (co) polymer, a poly(meth)acrylate (PMA), or mixtures thereof. In one embodiment, the polymeric viscosity modifier is an olefin (co)polymer.

The olefin polymer may be derived from isobutylene or isoprene. In one embodiment, the olefin polymer is prepared from ethylene and a higher olefin within the range of C3-C10 alpha-mono-olefins, for example, the olefin polymer may be prepared from ethylene and propylene.

In one embodiment, the olefin polymer may be a polymer of 15 to 80 mole percent of ethylene, for example, 30 mol percent to 70 mol percent ethylene and from and from 20 to 85 mole percent of C3 to C10 mono-olefins, such as propylene, for example, 30 to 70 mol percent propylene or higher mono-olefins. Terpolymer variations of the olefin copolymer may also be used and may contain up to 15 mol percent of a non-conjugated diene or triene. Non-conjugated dienes or trienes may have 5 to about 14 carbon atoms. The non-conjugated diene or triene monomers may be characterized by the presence of a vinyl group in the structure and can include cyclic and bicycle compounds. Representative dienes include 1,4-hexadiene, 1,4-cyclohexadiene, dicyclopentadiene, 5-ethyldiene-2-norbornene, 5-methylene-2-norbornene, 1,5-heptadiene, and 1,6-octadiene.

In one embodiment, the olefin copolymer may be a copolymer of ethylene, propylene, and butylene. The polymer may be prepared by polymerizing a mixture of monomers comprising ethylene, propylene and butylene. These polymers may be referred to as copolymers or terpolymers. The terpolymer may comprise from about 5 mol % to about 20 mol %, or from about 5 mol % to about 10 mol % structural units derived from ethylene; from about 60 mol % to about 90 mol %, or from about 60 mol % to about 75 mol structural units derived from propylene; and from about 5 mol % to about 30 mol %, or from about 15 mol % to about 30 mol % structural units derived from butylene. The butylene may comprise any isomers or mixtures thereof, such as n-butylene, iso-butylene, or a mixture thereof. The butylene may comprise butene-1. Commercial sources of butylene may comprise butene-1 as well as butene-2 and butadiene. The butylene may comprise a mixture of butene-1 and isobutylene wherein the weight ratio of butene-1 to isobutylene is about 1:0.1 or less. The butylene may comprise butene-1 and be free of or essentially free of isobutylene.

In one embodiment, the olefin copolymer may be a copolymer of ethylene and butylene. The polymer may be prepared by polymerizing a mixture of monomers comprising ethylene and butylene wherein, the monomer composition is free of or substantially free of propylene monomers (i.e. contains less than 1 weight percent of intentionally added monomer). The copolymer may comprise 30 to 50 mol percent structural units derived from butylene; and from about 50 mol percent to 70 mol percent structural units derived from ethylene. The butylene may comprise a mixture of butene-1 and isobutylene wherein the weight ratio of butene-1 to isobutylene is about 1:0.1 or less. The butylene may comprise butene-1 and be free of or essentially free of isobutylene.

Useful olefin polymers, in particular, ethylene-α-olefin copolymers have a number average molecular weight ranging from 4500 to 500,000, for example, 5000 to 100,000, or 7500 to 60,000, or 8000 to 45,000.

The formation of functionalized ethylene-α-olefin copolymer is well known in the art, for instance those described in U.S. Pat. No. 7,790,661 column 2, line 48 to column 10, line 38. Additional detailed descriptions of similar functionalized ethylene-α-olefin copolymers are found in International Publication WO2006/015130 or U.S. Pat. Nos. 4,863,623; 6,107,257; 6,107,258; 6,117,825; and 7,790,661. In one embodiment the functionalized ethylene-α-olefin copolymer may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment, the lubricating composition comprises a dispersant viscosity modifier (DVM). The DVM may comprise an olefin polymer that has been modified by the addition of a polar moiety.

The olefin polymers are functionalized by modifying the polymer by the addition of a polar moiety. In one useful embodiment, the functionalized copolymer is the reaction product of an olefin polymer grafted with an acylating agent. In one embodiment, the acylating agent may be an ethylenically unsaturated acylating agent. Useful acylating agents are typically α,β unsaturated compounds having at least one ethylenic bond (prior to reaction) and at least one, for example two, carboxylic acid (or its anhydride) groups or a polar group which is convertible into said carboxyl groups by oxidation or hydrolysis. The acylating agent grafts onto the olefin polymer to give two carboxylic acid functionalities. Examples of useful acylating agents include maleic anhydride, chlormaleic anhydride, itaconic anhydride, or the reactive equivalents thereof, for example, the corresponding dicarboxylic acids, such as maleic acid, fumaric acid, cinnamic acid, (meth)acrylic acid, the esters of these compounds and the acid chlorides of these compounds.

In one embodiment, the functionalized ethylene-α-olefin copolymer comprises an olefin copolymer grafted with the acyl group which is further functionalized with a hydrocarbyl amine, a hydrocarbyl alcohol group, amino- or hydroxy-terminated polyether compounds, and mixtures thereof.

Amine functional groups may be added to the olefin polymer by reacting the olefin copolymer (typically, an ethylene-α-olefin copolymer, such as an ethylene-propylene copolymer) with an acylating agent (typically maleic anhydride) and a hydrocarbyl amine having a primary or secondary amino group. In one embodiment, the hydrocarbyl amine may be selected from aromatic amines, aliphatic amines, and mixtures thereof.

In one embodiment, the hydrocarbyl amine component may comprise at least one aromatic amine containing at least one amino group capable of condensing with said acyl group to provide a pendant group and at least one additional group comprising at least one nitrogen, oxygen, or sulfur atom, wherein said aromatic amine is selected from the group consisting of (i) a nitro-substituted aniline, (ii) an amine comprising two aromatic moieties linked by a C(O)NR— group, a —C(O)O— group, an —O— group, an N═N— group, or an —SO2- group where R is hydrogen or hydrocarbyl, one of said aromatic moieties bearing said condensable amino group, (iii) an aminoquinoline, (iv) an aminobenzimidazole, (v) an N,N-dialkylphenylenediamine, (vi), an aminodiphenylamine (also N-phenyl-phenylenediamine), and (vii) a ring-substituted benzylamine.

In another one embodiment, the polar moiety added to the functionalized ethylene-α-olefin copolymer may be derived from a hydrocarbyl alcohol group, containing at least one hydroxy group capable of condensing with said acyl group to provide a pendant group and at least one additional group comprising at least one nitrogen, oxygen, or sulfur atom. The alcohol functional groups may be added to the olefin polymer by reacting the olefin copolymer with an acylating agent (typically maleic anhydride) and a hydrocarbyl alcohol. The hydrocarbyl alcohol may be a polyol compound. Suitable hydrocarbyl polyols include ethylene glycol and propylene glycol, trimethylol propane (TMP), pentaerythritol, and mixtures thereof.

In another one embodiment, the polar moiety added to the functionalized ethylene-α-olefin copolymer may be amine-terminated polyether compounds, hydroxy-terminated polyether compounds, and mixtures thereof. The hydroxy terminated or amine terminated polyether may be selected from the group comprising polyethylene glycols, polypropylene glycols, mixtures of one or more amine terminated polyether compounds containing units derived from ethylene oxides, propylene oxides, butylene oxides or some combination thereof, or some combination thereof. Suitable polyether compounds include Synalox® line of polyalkylene glycol compounds, the UCON™ OSP line of polyether compounds available from Dow Chemical, Jeffamine® line of polyether amines available from Huntsman.

In one embodiment, lubricating composition may comprise a poly(meth)acrylate polymeric viscosity modifier. As used herein, the term "(meth)acrylate" and its cognates means either methacrylate or acrylate, as will be readily understood.

In one embodiment, the poly(meth)acrylate polymer is prepared from a monomer mixture comprising (meth)acrylate monomers having alkyl groups of varying length. The (meth)acrylate monomers may contain alkyl groups that are straight chain or branched chain groups. The alkyl groups may contain 1 to 24 carbon atoms, for example 1 to 20 carbon atoms.

The poly(meth)acrylate polymers described herein are formed from monomers derived from saturated alcohols, such as methyl (meth)acrylate, ethyl (meth)acrylate, propyl (meth)acrylate, butyl (meth)acrylate, 2-methylpentyl (meth) acrylate, 2-propylheptyl (meth)acrylate, 2-butyloctyl (meth) acrylate, 2-ethylhexyl (meth)acrylate, octyl (meth)acrylate, nonyl (meth)acrylate, isooctyl (meth)acrylate, isononyl (meth)acrylate, 2-tert-butylheptyl (meth)acrylate, 3-isopropylheptyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, hexadecyl (meth)acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl-(meth)acrylate, octadecyl (meth)acrylate, nonadecyl (meth)acrylate, eicosyl (meth)acrylate, (meth)acrylates derived from unsaturated alcohols, such as oleyl (meth)acrylate; and cycloalkyl (meth)acrylates, such as 3-vinyl-2-butylcyclohexyl (meth) acrylate or bornyl (meth)acrylate.

Other examples of monomers include alkyl (meth)acrylates with long-chain alcohol-derived groups which may be obtained, for example, by reaction of a (meth)acrylic acid (by direct esterification) or methyl (meth)acrylate (by transesterification) with long-chain fatty alcohols, in which reaction a mixture of esters such as (meth)acrylate with alcohol groups of various chain lengths is generally obtained. These fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

In one embodiment, the poly(meth)acrylate polymer comprises a dispersant monomer; dispersant monomers include those monomers which may copolymerize with (meth)acrylate monomers and contain one or more heteroatoms in addition to the carbonyl group of the (meth)acrylate. The dispersant monomer may contain a nitrogen-containing group, an oxygen-containing group, or mixtures thereof.

The oxygen-containing compound may include hydroxyalkyl(meth)acrylates such as 3-hydroxypropyl(meth)acrylate, 4-dihydroxybutyl(meth)acrylate, 2-hydroxyethyl(meth) acrylate, 2-hydroxypropyl(meth)acrylate, 2,5-dimethyl-1,6-hexanediol (meth)acrylate, 1,10-decanediol(meth)acrylate, carbonyl-containing (meth)acrylates such as 2-carboxyethyl (meth)acrylate, carboxymethyl(meth)acrylate, oxazolidinylethyl(meth)acrylate, N-(methacryloyloxy)formamide, acetonyl(meth)acrylate, N-methacryloylmorpholine, N-methacryloyl-2-pyrrolidinone, N-(2-methacryloyl-oxyethyl)-2-pyrrolidinone, N-(3-methacryloyloxypropyl)-2-pyrrolidinone, N-(2-methacryloyloxypentadecyl)-2-pyrrolidinone, N-(3-methacryloyloxy-heptadecyl)-2-pyrrolidinone; glycol di(meth)acrylates such as 1,4-butanediol(meth)acrylate, 2-butoxyethyl(meth)acrylate, 2-ethoxyethoxymethyl(meth)acrylate, 2-ethoxyethyl(meth) acrylate, or mixtures thereof.

The nitrogen-containing compound may be a (meth) acrylamide or a nitrogen containing (meth)acrylate monomer. Examples of a suitable nitrogen-containing compound include N,N-dimethylacrylamide, N-vinyl carbonamides such as N-vinyl-formamide, vinyl pyridine, N-vinylacetoamide, N-vinyl propionamides, N-vinyl hydroxy-acetoamide, N-vinyl imidazole, N-vinyl pyrrolidinone, N-vinyl caprolactam, dimethylaminoethyl acrylate (DMAEA), dimethylaminoethyl methacrylate (DMAEMA), dimethylaminobutyl acrylamide, dimethylaminopropyl meth-acrylate (DMAPMA), dimethylaminopropyl acrylamide, dimethylaminopropyl methacrylamide, dimethylaminoethyl acrylamide or mixtures thereof.

Dispersant monomers may be present in an amount up to 5 mol percent of the monomer composition of the (meth) acrylate polymer. In one embodiment, the poly(meth)acrylate is present in an amount 0 to 5 mol percent, 0.5 to 4 mol percent, or 0.8 to 3 mol percent of the polymer composition. In one embodiment, the poly(meth)acrylate is free of or substantially free of dispersant monomers.

In one embodiment, the poly(meth)acrylate comprises a block copolymer or tapered block copolymer. Block copolymers are formed from a monomer mixture comprising one or more (meth)acrylate monomers, wherein, for example, a first (meth)acrylate monomer forms a discrete block of the polymer joined to a second discrete block of the polymer formed from a second (meth)acrylate monomer. While block copolymers have substantially discrete blocks formed from the monomers in the monomer mixture, a tapered block copolymer may be composed of, at one end, a relatively pure first monomer and, at the other end, a relatively pure second monomer. The middle of the tapered block copolymer is more of a gradient composition of the two monomers.

In one embodiment, the poly(meth)acrylate polymer (P) is a block or tapered block copolymer that comprises at least one polymer block ($B_1$) that is insoluble or substantially insoluble in the base oil and a second polymer block ($B_2$) that is soluble or substantially soluble in the base oil.

In one embodiment, the poly(meth)acrylate polymers may have an architecture selected from linear, branched, hyperbranched, cross-linked, star (also referred to as "radial"), or combinations thereof. Star or radial refers to multi-armed polymers. Such polymers include (meth)acrylate-containing polymers comprising 3 or more arms or branches, which, in some embodiments, contain at least about 20, or at least 50 or 100 or 200 or 350 or 500 or 1000 carbon atoms. The arms are generally attached to a multivalent organic moiety which acts as a "core" or "coupling agent." The multi-armed polymer may be referred to as a radial or star polymer, or even a "comb" polymer, or a polymer otherwise having multiple arms or branches as described herein.

Linear poly(meth)acrylates, random, block or otherwise, may have weight average molecular weight (Mw) of 1000 to 400,000 Daltons, 1000 to 150,000 Daltons, or 15,000 to 100,000 Daltons. In one embodiment, the poly(meth)acrylate may be a linear block copolymer with a Mw of 5,000 to 40,000 Daltons, or 10,000 to 30,000 Daltons.

Radial, cross-linked or star copolymers may be derived from linear random or di-block copolymers with molecular weights as described above. A star polymer may have a weight average molecular weight of 10,000 to 1,500,000 Daltons, or 40,000 to 1,000,000 Daltons, or 300,000 to 850,000 Daltons.

The lubricating compositions may comprise 0.05 weight % to 2 weight %, or 0.08 weight % to 1.8 weight %, or 0.1 to 1.2 weight % of the one or more polymeric viscosity modifiers and/or dispersant viscosity modifiers as described herein.

Other Performance Additives:

Various embodiments of the compositions disclosed herein may optionally comprise one or more additional performance additives. These additional performance additives may include one or more metal deactivators, friction modifiers, corrosion inhibitors, extreme pressure agents, foam inhibitors, demulsifiers, pour point depressants, seal swelling agents, and any combination or mixture thereof. Typically, fully-formulated lubricating oil will contain one or more of these performance additives, and often a package of multiple performance additives. However, such performance additives are included based on the application of the lubricating composition, and the specific performance additive and treat rate thereof would be apparent to one of ordinary skill in the art in view of this disclosure.

In one embodiment, a lubricating composition further comprises a friction modifier. Examples of friction modifiers include long chain fatty acid derivatives of amines, fatty esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides. The term fatty, as used herein, can mean having a C8-22 linear alkyl group.

Friction modifiers may also encompass materials such as sulfurized fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

In one embodiment, the friction modifier may be a long chain fatty acid ester. In another embodiment the long chain fatty acid ester may be a mono-ester or a diester or a mixture thereof, and in another embodiment, the long chain fatty acid ester may be a triglyceride.

In one embodiment, a lubricating composition may further comprise a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm, or 5 ppm to 300 ppm, or 20 ppm to 250 ppm of molybdenum Other performance additives such as corrosion inhibitors include those described in paragraphs 5 to 8 of U.S. application Ser. No. 05/038,319, published as WO2006/047486, octyl octanamide, condensation products of dodecenyl succinic acid or anhydride and a fatty acid such as oleic acid with a polyamine. In one embodiment, the corrosion inhibitors include the Synalox® (a registered trademark of The Dow Chemical Company) corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

The lubricating composition may further include metal deactivators, including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors, including copolymers of ethyl acrylate and 2-ethylhexylacrylate and copolymers of ethyl acrylate and 2-ethylhexylacrylate and vinyl acetate; demulsifiers including trialkyl phosphates, polyethylene glycols, polyethylene oxides, polypropylene oxides and (ethylene oxide-propylene oxide) polymers; and pour point depressants, including esters of maleic anhydride-styrene, polymethacrylates, polyacrylates or polyacrylamides.

Pour point depressants that may be useful in the lubricating compositions disclosed herein further include polyalphaolefins, esters of maleic anhydride-styrene, poly(meth) acrylates, polyacrylates or polyacrylamides.

In different embodiments, the lubricating composition may have a composition as described in the following table:

| | Embodiments (wt %) | | |
|---|---|---|---|
| Additive | A | B | C |
| Phosphorus-containing salt additive | 0.1 to 5 | 0.15 to 2 | 0.2 to 0.8 |
| Zinc dialkyldithiophosphates | 0.1 to 1.5 | 0 to 0.5 | 0 to 0.1 |
| PIBsuccinimide Dispersants | 0.8 to 8 | 1.5 to 6 | 2.5 to 5.5 |
| Metal Sulfonate Detergents | 0.2 to 4 | 0.5 to 2 | 0.8 to 1.5 |
| Metal phenate detergents | 0 to 1 | 0.1 to 0.8 | 0.15 to 0.5 |
| Other Antiwear Agents | 0 to 4 | 0.1 to 2 | 0.5 to 1.5 |
| Ashless Antioxidants | 0.5 to 6 | 1.2 to 5 | 2 to 4 |
| Viscosity Modifier | 0 or 0.1 to 4.5 | 0.5 to 4 | 0.8 to 2.5 |
| Friction Modifier | 0 or 0.05 to 4 | 0.05 to 3 | 0.1 to 2 |
| Any Other Performance Additive | 0 or 0.05 to 10 | 0 or 0.05 to 8 | 0 or 0.05 to 6 |
| Oil of Lubricating Viscosity | Balance to 100% | | |

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); [0081] substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and components within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, or compositions, which can, of course, vary. It is also to be understood that the terminology used herein is for the purpose of describing particular embodiments only, and is not intended to be limiting.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure may be described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 wt. % refers to groups having 1, 2, or 3 wt. %. Similarly, a group having 1-5 wt. % refers to groups having 1, 2, 3, 4, or 5 wt. %, and so forth, including all points therebetween.

The instant disclosure is suitable for lubricant formulations exhibiting good wear properties with a decrease in the overall phosphorus content, which may be better understood with reference to the following examples:

Examples

The invention will be further illustrated by the following examples, which set forth particularly advantageous embodiments. While the examples are provided to illustrate the invention, they are not intended to limit it.

Additive A: Preparation of a Maleated Ethylene-Propylene N-Aminopropyl Morpholine Dispersant Viscosity Modifier To a 12 L four-necked flask equipped with a thermocouple, overhead stirrer, gas inlet tube, Dean-Stark trap, and Friedricks condenser is charged maleated ethylene-propylene copolymer (derived from 40k Dalton copolymer an average of ~14 succinate groups per polymer) (760 g) and group III base oil (5238 g). The mixture is heated to 110° C. under N2 purge and N-(aminopropyl)morpholine (144.4 g) is added dropwise over 5 minutes. The reaction mixture is heated to 160° C. while stirring and held at temperature for 5.5 hours. The product mixture is cooled to ambient temperature and collected without further purification.

Additive B: Preparation of a Phosphorus-Containing Salt of a Maleated Ethylene-Propylene N-Aminopropylmorpholine Dispersant Viscosity Modifier A 3 L, 4-neck flask equipped with a mechanical stirrer, thermowell, sub-surface nitrogen inlet, and Dean-Stark trap with condenser is charged with N-aminopropyl morpholine dispersant viscosity modifier of Example A (1500 g). O,O-bis(4-methyl-2-pentyl) dithiophosphoric acid (17.7 g) is added dropwise via subsurface addition funnel. The reaction mixture is stirred and held at 70° C. for 1 hour, after which the viscosity is noticeably higher. The product is cooled to ambient temperature and collected without further purification.

Lubricating Compositions

A series of 5W-30 diesel engine lubricants in Group III base oils of lubricating viscosity are prepared containing the additives described above as well as conventional additives including polyisobutenylsuccinimide dispersants, overbased detergents, antioxidants (combination of phenolic ester and diarylamine), zinc dialkyldithiophosphate (ZDDP), as well as other performance additives as follows (Table 1). The viscosity and elemental contents of each of the examples are also presented in the table in part to provide a proper comparison between the comparative and invention examples.

TABLE 1

| Lubricating Compositions[1] | | | |
|---|---|---|---|
| | EX1 | EX2 | EX3 |
| High VI Group III Base Oil | | | |
| EP-DVM with aromatic amine[2] | 0.24 | | |
| ADD A | | 0.24 | |
| ADD B | | | 0.24 |
| PIBsuccinimide dispersant[3] | 4.1 | 4.1 | 4.1 |
| Borated PIBsuccinimide dispersant[4] | 1 | 1 | 1 |
| Overbased Calcium sulfonate[5] | 0.75 | 0.75 | 0.75 |
| Overbased Magnesium sulfonate | 0.42 | 0.42 | 0.42 |
| Magnesium phenate[6] | 0.25 | 0.25 | 0.25 |
| Zinc dialkyldilhiophosphate[7] | 0.78 | 0.78 | |
| Diarylamine Antioxidant | 2 | 2 | 2 |
| Hindered phenol antioxidant | 0.8 | 0.8 | 0.8 |
| Polymeric VI Improver[8] | 0.14 | 0.14 | 0.14 |
| Additional Additives[9] | 1.48 | 1.48 | 1.48 |
| Calcium (% weight) | 0.094 | 0.095 | 0.095 |
| Magnesium (% weight) | 0.075 | 0.078 | 0.080 |
| Boron (% weight) | 0.020 | 0.020 | 0.020 |
| Phosphorus (% weight) | 0.081 | 0.078 | 0.043 |
| Zinc (% weight) | 0.086 | 0.085 | 0.044 |
| Kinematic viscosity 100° C. (cSt) (ASTM D445) | 9.91 | 9.63 | 9.64 |
| High Temperature High Shear Viscosity (cP) (ASTM D4683) | 3.05 | 3.02 | 3.02 |
| CCS at −30° C. (cP) (ASTM D5293) | 5430 | 5080 | 4980 |

[1]All treat rates are oil free unless otherwise indicated

[2]Acylated ethylene-propylene copolymer (41 weight % ethylene; Mn = ~50 k Da), aminated with nitroaniline

[3]Mixture of dispersants derived from low and high vinylidene polyisobutylene imidated with ethylene polyamines and aromatic polyamines

[4]Borated polyisobutenylsuccinimide (2300 Mn PIB), aminated with polyamine bottoms (TBN 56 mg KOH/g) (1 wt % boron)

[5]Mixture of high metal ratio (>12) and low metal ratio (<5) overbased calcium alkylbenzene sulfonate detergents

[6]Hydrocarbylene coupled alkylphenol detergent (TBN 140 mg KOH/g; 3 wt % Mg)

[7]Combination of secondary C3 and C6 alkyl ZDDP

[8]Styrene-butadiene block copolymer

[9]Additional additives include corrosion inhibitors, pourpoint depressants, anti-foam agents, ashless TBN boosters, and supplemental soot dispersant Wear Testing The resistance to cam and tappet wear provided by the dispersant viscosity modifier of the invention is measured according to the Cummins® ISB engine test (ASTM D7484-11).

TABLE 2

Fired Engine Testing Wear Results (Cummins ISB)

| | EX1 | EX2 | EX3 |
|---|---|---|---|
| Tappet Weight Loss (mg) | 67.6 | 66 | 54.6 |
| Cam Wear (μm) | 29.4 | 29.8 | 53.3 |

The results obtained from the fired diesel engine test show that acceptable levels of wear are observed with the low phosphorus lubricant in the presence of the salted DVM additive.

What is claimed is:

1. An engine lubricating composition comprising:

an oil of lubricating viscosity; and a phosphorus-containing salt of an acylated ethylene-α-olefin polymer substituted with an aliphatic diamine having at least one primary amine and a tertiary amine, wherein the aliphatic diamine is amino-propyl morpholine, the lubricating composition having a total phosphorus content in an amount of 200 ppm to 600 ppm by weight of the lubricating composition;

wherein the lubricating composition has a high temperature, high shear velocity (HTHS) of 1.5 mPa-s to 3.5 mPa-s as measured at 150° C. per ASTM D4683 and wherein the lubricating composition comprises a zinc dialkyldithiophosphate antiwear additive in an amount of from 0.1 wt % to 0.5 wt % of the lubricating composition.

2. The composition of claim 1, wherein the ethylene-α-olefin polymer has a number average molecular weight of 8000 Daltons up to 100,000 Daltons.

3. The composition of claim 1, wherein the ethylene-α-olefin polymer is an ethylene-propylene copolymer.

4. The composition of claim 1, wherein the ethylene-α-olefin polymer includes an acyl group from an acylating agent selected from the group consisting of maleic anhydride, itaconic anhydride, chlormaleic anhydride, maleic acid, fumaric acid, (meth)acrylic acid, cinnamic acid, reactive esters of any of the foregoing, reactive chlorides of any of the foregoing, and combinations thereof.

5. The composition of claim 1 wherein the phosphorus-containing salt is derived from a phosphorus-containing acid represented by the formula:

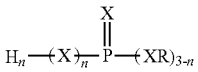

wherein each X is independently sulfur or oxygen;

n=1 or 2; and each R group is a hydrocarbyl group containing 6 to 24 carbon atoms.

6. The composition of claim 1, wherein the phosphorus-containing salt is derived from a $C_1$-$C_{14}$ alkyldithiophosphoric acid.

7. The composition of preceding claim 1, wherein the amine substituted acylated polymer is represented by the formulae:

$R_2R_3N—R_1—NH_{(2-x)}—C(=O)_x$-(ethylene-α-olefin polymer), wherein, $R_1$ is a linear or branched, optionally substituted, alkyl having from 1 to 10 carbon atoms or a hydrocarbyl group having 1-12 carbon atoms;

$R_2$ and $R_3$ along with the adjacent N form a 6-membered ring, optionally, having at least one heteroatom; and x is 1 or 2.

8. The composition of claim 1, wherein the phosphorus-containing salt of an acylated ethylene-α-olefin polymer substituted with an aliphatic polyamine having at least one primary amine and a tertiary amine is present in the lubricating composition in an amount of from 0.1 wt % to 5 wt %.

9. The composition of claim 1, further comprising a dispersant present in an amount of from 0.8 wt % to 1.5 wt %.

10. The composition of claim 9, wherein the dispersant is a PIB succinimide dispersant.

11. The composition of claim 1, further comprising a metal-based detergent.

12. The composition of claim 11, wherein the metal-based detergent is selected from one or more of a metal sulfonate detergent and a metal phenate detergent wherein the metal sulfonate detergent is present in an amount of from 0.2 wt % to 4 wt % and the metal phenate detergent is present in an amount of from 0 wt % to 1 wt %.

13. The composition of claim 1, further comprising an ashless antioxidant present in an amount of from 0.5 wt % to 6 wt %.

14. A method for lubricating an internal combustion engine comprising:

supplying to an internal combustion engine having a reference mass exceeding 2,610 kg a lubricating composition according to claim 1.

* * * * *